US008427272B1

(12) United States Patent
Columbus et al.

(10) Patent No.: US 8,427,272 B1
(45) Date of Patent: Apr. 23, 2013

(54) METHOD OF REDUCING AUDIBLE NOISE IN MAGNETIC CORES AND MAGNETIC CORES HAVING REDUCED AUDIBLE NOISE

(75) Inventors: Mark Robert Columbus, Myrtle Beach, SC (US); Robert Brown, Murrells Inlet, SC (US); Kengo Takahashi, Myrtle Beach, SC (US); Ryusuke Hasegawa, Morristown, NJ (US)

(73) Assignee: Metglas, Inc., Conway, SC (US)

( * ) Notice: Subject to any disclaimer, the term of this patent is extended or adjusted under 35 U.S.C. 154(b) by 0 days.

(21) Appl. No.: 13/283,902

(22) Filed: Oct. 28, 2011

(51) Int. Cl.
*H01F 27/24* (2006.01)
*H01F 27/26* (2006.01)
*H01F 3/04* (2006.01)

(52) U.S. Cl.
USPC ..... 336/234; 336/219; 336/210; 29/609

(58) Field of Classification Search ..... 336/210, 336/211, 213, 219, 233, 234; 29/602.1, 609
See application file for complete search history.

(56) References Cited

U.S. PATENT DOCUMENTS 4,142,571 A 3/1979 Narasimhan
4,524,342 A 6/1985 Mas
4,709,471 A * 12/1987 Valencic et al. ..... 29/605
4,734,975 A 4/1988 Ballard et al.
4,903,396 A * 2/1990 Grimes et al. ..... 29/606
5,179,776 A * 1/1993 Boenitz et al. ..... 29/609
5,426,846 A * 6/1995 White et al. ..... 29/609
7,289,013 B2 10/2007 Decristofaro et al.
7,508,350 B2 * 3/2009 Hein et al. ..... 343/787
2010/0175793 A1 7/2010 Hasegawa et al.
2011/0221298 A1 9/2011 Calley et al.
2011/0234360 A1 9/2011 Nakanoue et al.

OTHER PUBLICATIONS

International Search Report issued Jan. 9, 2013 in corresponding International Patent Application No. PCT/US2012/061976.

* cited by examiner

*Primary Examiner* — Mohamad Musleh
*Assistant Examiner* — Joselito Baisa

(57) ABSTRACT

An amorphous alloy-based magnetic core with reduced audible noise and a method of making the amorphous alloy-based magnetic core emanating low audible noise, including: placing the core with multiple layers of high strength tape on the core legs, wherein the tapes have a high tensile strength, high dielectric strength and high service temperature, resulting in reduced level of audible noise. When operated under optimum condition, the reduced level of audible noise is 6-10 dB less when compared with a same-size core that has been coated with resin instead.

16 Claims, 9 Drawing Sheets

Operation (i)

Operation (a)

Operation (b)

Operation (c)

Operation (d)

Operation (e)

Operation (f)

Operation (g)

Operation (h)

Operation (i)

Operation (j)

METHOD OF REDUCING AUDIBLE NOISE IN MAGNETIC CORES AND MAGNETIC CORES HAVING REDUCED AUDIBLE NOISE

BACKGROUND

1. Field

Embodiments of the invention relate to a method of reducing audible noise emanating from magnetic cores based on amorphous magnetic materials such as transformer cores. Further embodiments relate to magnetic cores having reduced audible noise.

2. Description of the Related Art

Iron-based amorphous alloy ribbon exhibits excellent soft magnetic properties including low magnetic core loss under AC excitation, finding its application in energy efficient magnetic devices such as transformers, motors, generators, energy management devices including pulse power generators and magnetic sensors. In these devices, amorphous ferromagnetic materials with high saturation inductions and low magnetic core loss are preferred. Although these features have been achieved in Fe-based amorphous alloys, their magnetostriction values tend to be somewhat higher than those of conventional crystalline Fe—Si alloys. Magnetostriction is one of the intrinsic properties of magnetic materials and is characterized by dimensional changes when the materials are magnetized from their remanent states. When a magnetic material expands along the direction of magnetization, the phenomenon is termed positive-magnetostrictive. When a magnetic material shrinks upon magnetization, the effect is called negative-magnetostrictive. In either case, the material vibrates mechanically under an AC excitation. Thus, when the material is used in a magnetic core that is under an AC excitation, the core emanates sound. One example is the familiar hum from electrical distribution transformers. Due to the on-going increase of population density in residential areas, the transformer noise is becoming an issue. Since the magnetostriction of a material is determined by its chemical composition and atomic or crystal structure, the sound level from a magnetic core is controlled by the design and fabrication of the core based on a given core material. Thus, the design and fabrication of a magnetic core based on amorphous magnetic materials must be optimized for its lowest sound levels, which is an aspect according to an embodiment of the present invention.

The amorphous Fe-based alloys are cast into ribbon forms due to the need for rapid solidification of molten alloys. The commercially available amorphous magnetic ribbon has a thickness ranging from about 15 μm to about 50 μm. When the relatively thin ribbon is wound to form a large-sized magnetic core, the side of the core must be mechanically reinforced to maintain its mechanical integrity. This is the case when the core is used as a distribution transformer core that has a physical cut in order that transformer electrical conductor windings can be inserted into the core. For example, U.S. Pat. No. 4,734,975 (hereinafter '975 patent) describes a method of coating the sides of a transformer core by using epoxy resin to strengthen the core mechanically. This method is currently used in a number of transformers based on amorphous alloy ribbon. During curing of the resin, however, mechanical stress is introduced on the sides of the core due to the thermal expansion coefficient difference between the core material and the resin, which increases the core's magnetic loss and exciting power. These increases in turn result in increased transformer's audible noise. Thus the effect must be mitigated, which is another aspect according to an embodiment of the invention. An additional aspect of the invention is to search for environmental-friendly core reinforcement materials. Currently, used polymer coating materials, such as epoxy resin, adhere strongly to the metallic magnetic cores but generate hazardous gases when the cores are remelted during recycling, which needs to be mitigated.

SUMMARY

In accordance with aspects of the invention, a method of reducing low audible noise of an amorphous alloy-based magnetic core includes: providing the magnetic core having four core legs arranged in a rectangular shape, the magnetic core further having: a first core leg, a second core leg being opposite to the first core leg and having a cut ribbon overlap section, a third core leg, and a fourth core leg being opposite to the third core leg; placing a plurality of non-overlapping high strength tapes on the sides of the third core leg and the fourth core leg, wherein the high strength tapes exhibit high mechanical strength, high dielectric strength, and high service temperature; wrapping a first layer of overlapping high strength tapes helically on the third core leg and the fourth core leg; placing a second layer of overlapping high strength tapes on a top face of the first core leg in a direction parallel to the length of the first core leg; placing a third layer of overlapping high strength tapes on the top face of the first core leg in a direction perpendicular to the length of the first core leg; placing a fourth layer of overlapping high strength tapes on a bottom face of the first core leg in a direction parallel to the length of the first core leg; and placing a fifth layer of overlapping high strength tapes on the bottom face of the first core leg in a direction perpendicular to the length of the first core leg, the magnetic core having a reduced level of audible noise emanating from the core.

According to one aspect of the invention, the method further includes exposing a portion of the first core leg that is without tape wrapping, a portion of the third core leg that is without tape wrapping, or a portion of the fourth core leg that is without tape wrapping to a transformer cooling media to assure core cooling during an operation of the core in an electrical distribution transformer.

According to one aspect of the invention, each of the first layer of overlapping high strength tapes, the second layer of overlapping high strength tapes, the third layer of overlapping high strength tapes, the fourth layer of overlapping high strength tapes, and the fifth layer of overlapping high strength tapes provide mechanical strength to the core.

According to one aspect of the invention, the core is operable up to 155° C., and the high strength tape has a tensile strength exceeding 250 N/cm and a dielectric strength exceeding 3000 volts, the high strength tape having good puncture, tear and thermal aging resistance.

According to one aspect of the invention, the magnetic core is wound with an amorphous magnetic tape or magnetic ribbon, wherein the magnetic ribbon is rapidly cast from its molten state of the alloy.

According to one aspect of the invention, the magnetic core wrapped with multiple layers of high strength tapes emanates sound power close to the sound power generated by a same-sized core with no tape wrapping.

According to one aspect of the invention, the reduced level of audible noise of the magnetic core is 6-10 dB less than a same-size magnetic core having resin as coating. According to another aspect of the invention, the layers of high strength tapes can be removed when the core is remelted for recycling.

According to further aspects of the invention, an amorphous alloy-based magnetic core having reduced audible noise includes: a rectangular shape core having four legs: a first core leg, a second core leg being opposite to the first core leg and having a cut ribbon overlap section, a third core leg, and a fourth core leg being opposite to the third core leg; a plurality of non-overlapping high strength tapes placed on the sides of the third core leg and the fourth core leg, wherein the high strength tapes exhibit high mechanical strength, high dielectric strength, and high service temperature; a first layer of overlapping high strength tapes wrapped helically on the third core leg and the fourth core leg; a second layer of overlapping high strength tapes placed on a top face of the first core leg in a direction parallel to the length of the first core leg; a third layer of overlapping high strength tapes placed on the top face of the first core leg in a direction perpendicular to the length of the first core leg; a fourth layer of overlapping high strength tapes placed on a bottom face of the first core leg in a direction parallel to the length of the first core leg; and a fifth layer of overlapping high strength tapes placed on the bottom face of the first core leg in a direction perpendicular to the length of the first core leg, wherein the magnetic core having a reduced level of audible noise emanating from the core.

BRIEF DESCRIPTION OF THE DRAWINGS

The invention will be more fully understood and further advantages will become apparent when reference is made to the following detailed description of the embodiments and the accompanying drawings in which.

DESCRIPTION OF EMBODIMENTS

Embodiments of the invention will be explained further below with reference to the accompanying drawings.

An amorphous alloy ribbon may be prepared as described in U.S. Pat. No. 4,142,571, by having a molten alloy ejected through a slotted nozzle onto a rotating chill body surface. The ribbon has a thickness ranging from about 15 μm to about 50 μm and a width ranging from about 25 mm to about 210 mm. Either as-cast ribbon or ribbon slit to a given width is wound into a magnetic core. In certain cases such as in an electrical power distribution transformer, the core has a gap such that a section of the core can be opened up to insert electrical conductor coils into the core. The wound core is then heat-treated to achieve the envisaged magnetic properties.

Figure 1A:
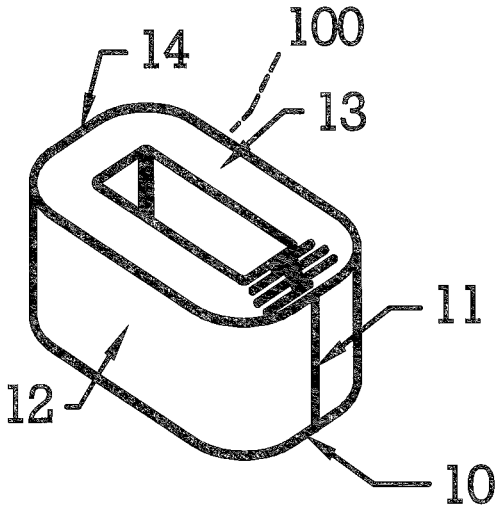
FIG. 1A is a perspective view of a magnetic core, before the magnetic core undergoes any wrapping operation.
Figure 1B:
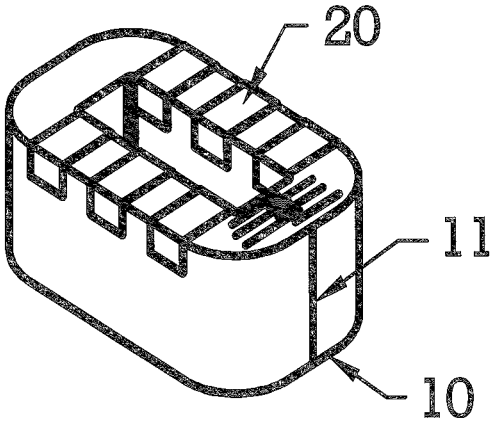
FIG. 1B is a perspective view of the magnetic core, after the magnetic core undergoes wrapping operation "a" with a high strength tape.
Figure 1C:
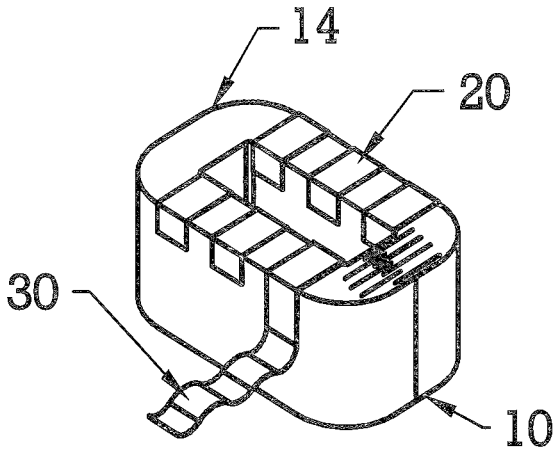
FIG. 1C is a perspective view of the magnetic core, after the magnetic core undergoes wrapping operation "b".
Figure 1D:
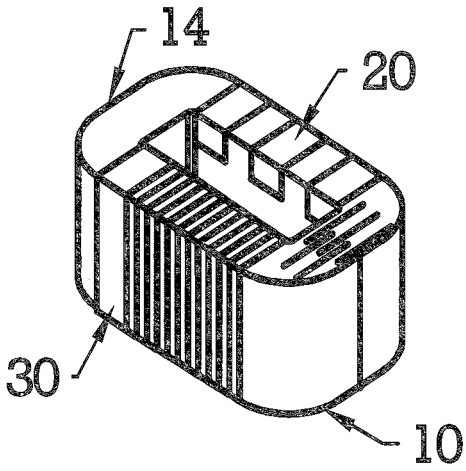
FIG. 1D is a perspective view of the magnetic core, after the magnetic core undergoes wrapping operation "c".
Figure 1E:
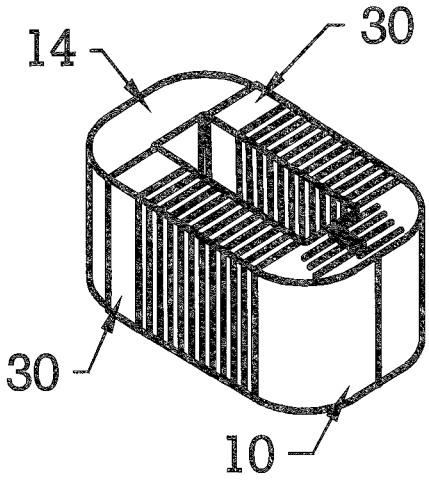
FIG. 1E is a perspective view of the magnetic core, after the magnetic core undergoes wrapping operation "d".
Figure 1F:
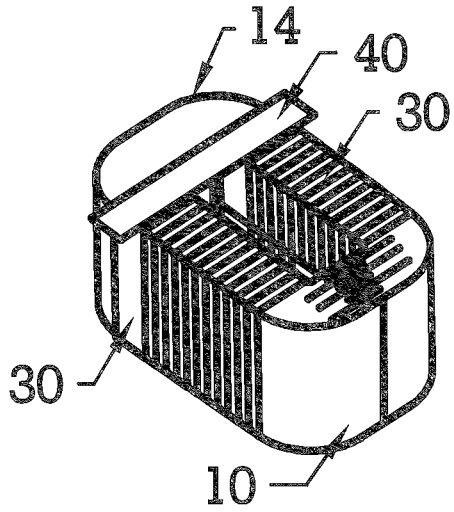
FIG. 1F is a perspective view of the magnetic core, after the magnetic core undergoes wrapping operation "e".
Figure 2A:
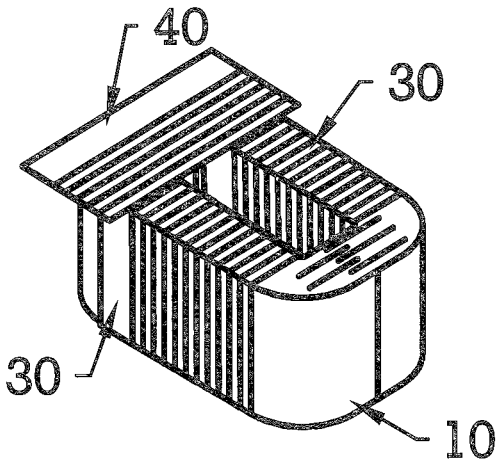
FIG. 2A is a perspective view of the magnetic core, after the magnetic core undergoes wrapping operation "f".
Figure 2B:
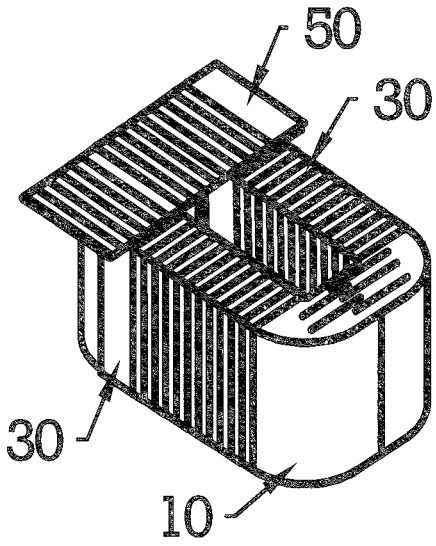
FIG. 2B is a perspective view of the magnetic core, after the magnetic core undergoes wrapping operation "g".
Figure 2C:
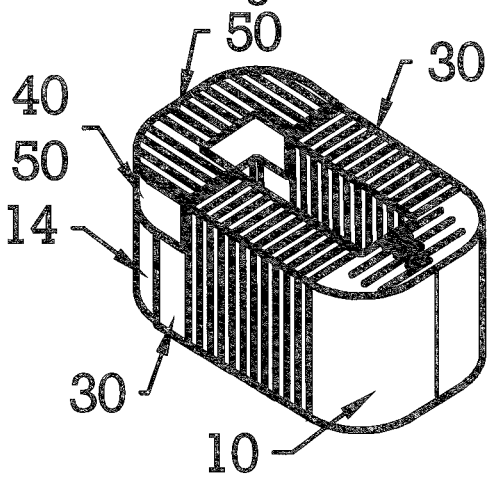
FIG. 2C is a perspective view of the magnetic core, after the magnetic core undergoes wrapping operation "h".
Figure 2D:
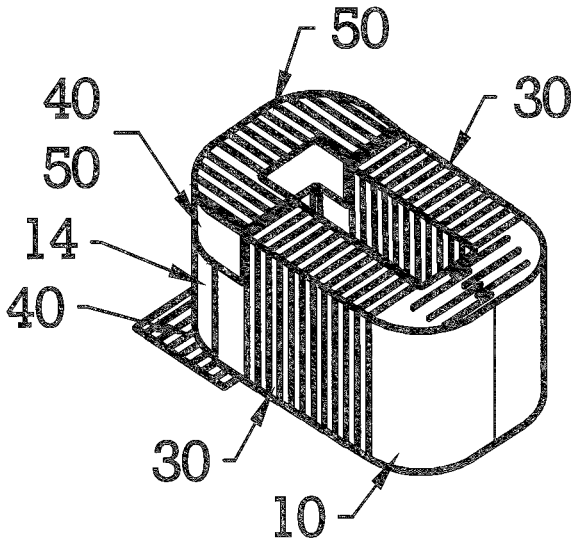
FIG. 2D is a perspective view of the magnetic core, after the magnetic core undergoes wrapping operation "i".
Figure 2E:
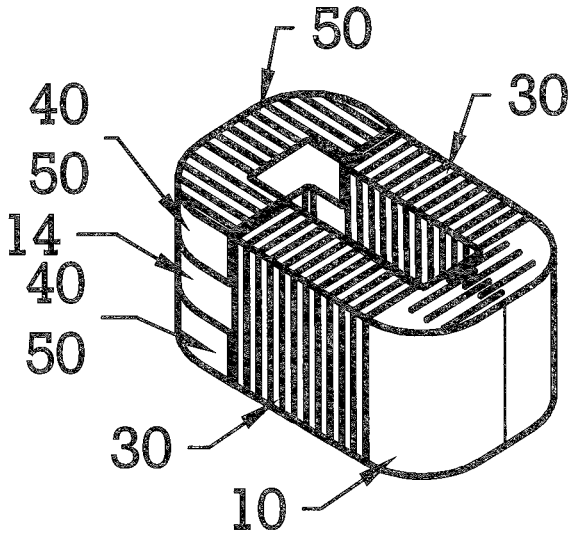
FIG. 2E is a perspective view of the magnetic core, after the magnetic core undergoes wrapping operation "j".
Figure 3:
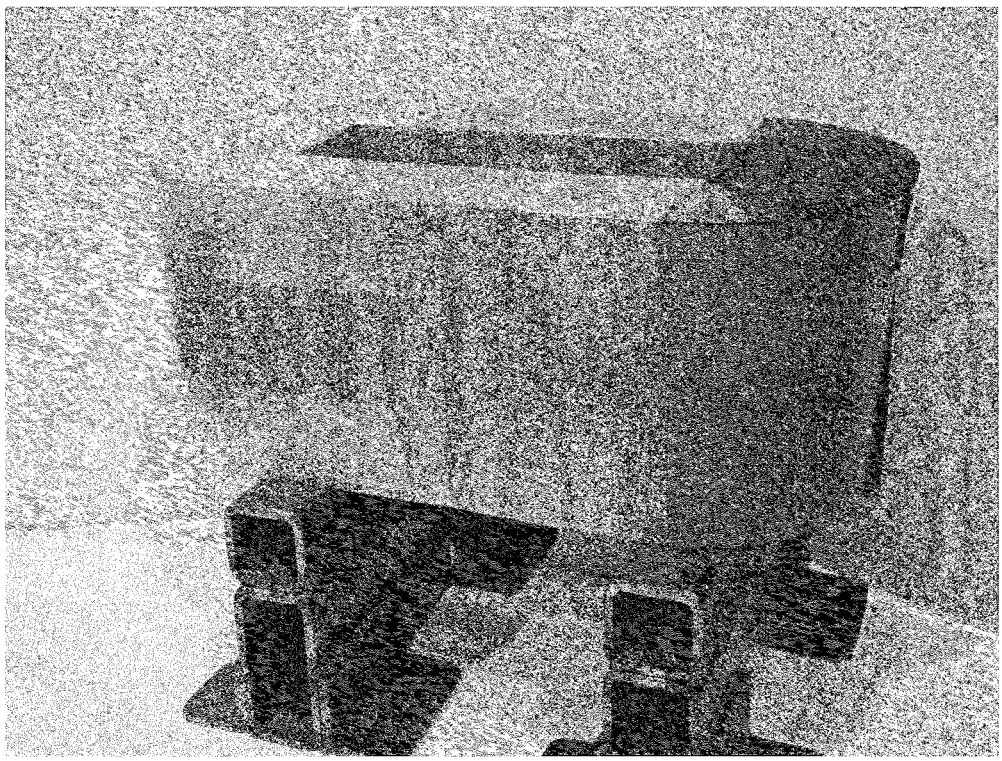
FIG. 3 is a picture taken of a magnetic core wrapped by an insulating high strength tape according to the wrapping operations of FIG. 1A through FIG. 1F, and of FIG. 2A through FIG. 2E, showing core leg 10 on the right, core leg 12 in the front and core leg 14 on the left; and depicting the entire core leg 10 as well as portions of core leg 12 and core leg 14 being without tape wrapping, which serve as core cooling conduit.

One such example of a heat-treated core is shown in FIG. 1A in which the core 100 has core legs 10, 12, 13 and 14 and a cut ribbon overlap section 11 on one of the core legs 10 as shown. The cut ribbon overlap section 11 is needed to allow insertion of transformer coils into the core by opening it up. A high strength tape 20 is placed on the sides of the core as illustrated in the wrapping operation "a" in FIG. 1B. Another layer of the tape 30 is wrapped around the core leg 12 as shown in the wrapping operation "b" in FIG. 10. As the wrapping operation "c" illustrates, the tape 30 is wound on the core leg 12 helically, covering the entire core leg as shown in FIG. 1D. The number of tape pieces and their lengths and widths depend on the size of the core. Operation "c" is repeated on core leg 13 as wrapping operation "d" illustrated in FIG. 1E. In the wrapping operation "e", another tape layer 40 wraps the core leg 14 which has no cut ribbon overlap section as shown in FIG. 1F. As shown in FIG. 2A, in the wrapping operation "f", the tape pieces 40 are placed parallel to leg 14 in an overlap fashion. In the wrapping operation "g", another layer of tape pieces 50 are placed over tape pieces 40 and parallel to core legs 12 and 13, culminating in the wrapping operation "h". Wrapping operations "f", "g" and "h" are repeated in wrapping operations "i" and "j", resulting in portions of the core 100 without tape wrapping between tape pieces on the core sides of core leg 14 and part of core legs 12 and 13. The core sections without tape wrapping serve as core cooling conduit, for instance, by being exposed to a transformer cooling media during an operation of the core in an electrical distribution transformer. When the wrapping operation "j" is completed, the final taped magnetic core has an appearance which is shown in FIG. 3.

A method of reducing audible noise in magnetic cores according to an embodiment of the invention includes the operations of providing the magnetic core having four core legs arranged in a rectangular shape, the magnetic core further comprising: a first core leg 14, a second core leg 10 being opposite to the first core leg and having a cut ribbon overlap section 11, a third core leg 12, and a fourth core leg 13 being opposite to the third core leg; placing a plurality of non-overlapping high strength tapes 20 on the sides of the third core leg and the fourth core leg, wherein the high strength tape exhibits high mechanical strength, high dielectric strength, and high service temperature; wrapping a first layer of overlapping high strength tapes 30 helically on the third core leg and the fourth core leg; placing a second layer of overlapping high strength tapes 40 on a top face of the first core leg in a direction parallel to the length of the first core leg; placing a third layer of overlapping high strength tapes 50 on the top face of the first core leg in a direction perpendicular to the length of the first core leg; placing a fourth layer of overlapping high strength tapes 40 on a bottom face of the first core leg in a direction parallel to the length of the first core leg; and placing a fifth layer of overlapping high strength tapes (50) on the bottom face of the first core leg in a direction perpendicular to the length of the first core leg, the magnetic core exhibits a reduced level of audible noise emanating from the core.

The high strength tape usable for the embodiment of the invention has high tensile strength and exhibits advantageous characteristics such as good puncture, abrasion, tear and thermal aging resistance, and a high dielectric strength. With regard to tensile strength, tapes having high tensile strength 250 N/cm or more, or preferably 512 N/cm are suitable. With regard to dielectric strength, tapes having a dielectric strength of 3000 volts or more, or preferably 5000 volts or more are useful.

In general, using high strength tape to wind the magnetic cores may be able to reduce audible noise emanating from the core in the range of about 6 dB to about 10 dB, when compared with magnetic cores that are only coated with resin.

A magnetic core having reduced audible noise according to an embodiment of the invention includes a rectangular shape core having four legs: a first core leg 14, a second core leg 10 being opposite to the first core leg and having a cut ribbon overlap section 11, a third core leg 12, and a fourth core leg 13 being opposite to the third core leg; a plurality of non-overlapping high strength tapes 20 placed on sides of the third core leg and the fourth core leg, wherein the high strength tapes exhibit high mechanical strength, high dielectric strength, and high service temperature; a first layer of overlapping high strength tapes 30 wrapped helically on the third core leg and the fourth core leg; a second layer of overlapping high strength tapes 40 placed on a top face of the first core leg in a direction parallel to the length of the first core leg; a third layer of overlapping high strength tapes 50 placed on the top face of the first core leg in a direction perpendicular to the length of the first core leg; a fourth layer of overlapping high strength tapes 40 placed on a bottom face of the first core leg in a direction parallel to the length of the first core leg; and fifth layer of overlapping high strength tapes 50 placed on the bottom face of the first core leg in a direction perpendicular to the length of the first core leg; wherein the magnetic core exhibits a reduced level of audible noise emanating from the core.

To establish a base line for comparative reference for magnetic property-related audible noise emanating from a magnetic core, magnetic cores with the same dimension as that of item 100 in FIG. 1A were built. The cores were then heat-treated to achieve their optimal magnetic performance and coated with epoxy resin on their sides following the teaching of U.S. Pat. No. '975.

The magnetic cores were tested by the methods specified in the ASTM Standards A912.

The cores were then tested for audible noise in terms of sound power at a commercial acoustic laboratory in accordance with ISO 3744 Standard. The details of the tests are given in the following Examples.

Example 1

Magnetic cores based on commercially available amorphous alloy Metglas®2605SA1 were tested for their audible noise. The test results are summarized in Table I, where audible noise is compared among differently prepared magnetic cores that are excited at induction levels 1.0-1.50 T at 60 Hz.

TABLE I

Sound power emanating from taped, epoxy coated (glued) and bare cores.

| Core | Sound Power (dB) Induction (T) at 60 Hz | | | | | | | |
|---|---|---|---|---|---|---|---|---|
| Type | 1.0 T | 1.1 T | 1.2 T | 1.3 T | 1.35 T | 1.4 T | 1.45 T | 1.5 T |
| Taped-A | 34.9 | 37.7 | 41.0 | 44.8 | 47.2 | 51.0 | 55.2 | 58.7 |
| Taped-B | 33.2 | 35.6 | 39.0 | 43.7 | 45.8 | 48.4 | 53.0 | 59.2 |
| Glued | 43.6 | 45.8 | 48.1 | 52.9 | 56.9 | 61.0 | 65.0 | 68.5 |
| Bare | 32.8 | 35.4 | 38.9 | 42.9 | 45.6 | 49.9 | 53.9 | 57.4 |

Tape A: Product Code 4237 (Intertape Polymer);
Tape B: Product Code 1711A (PPI)

Figure 4:
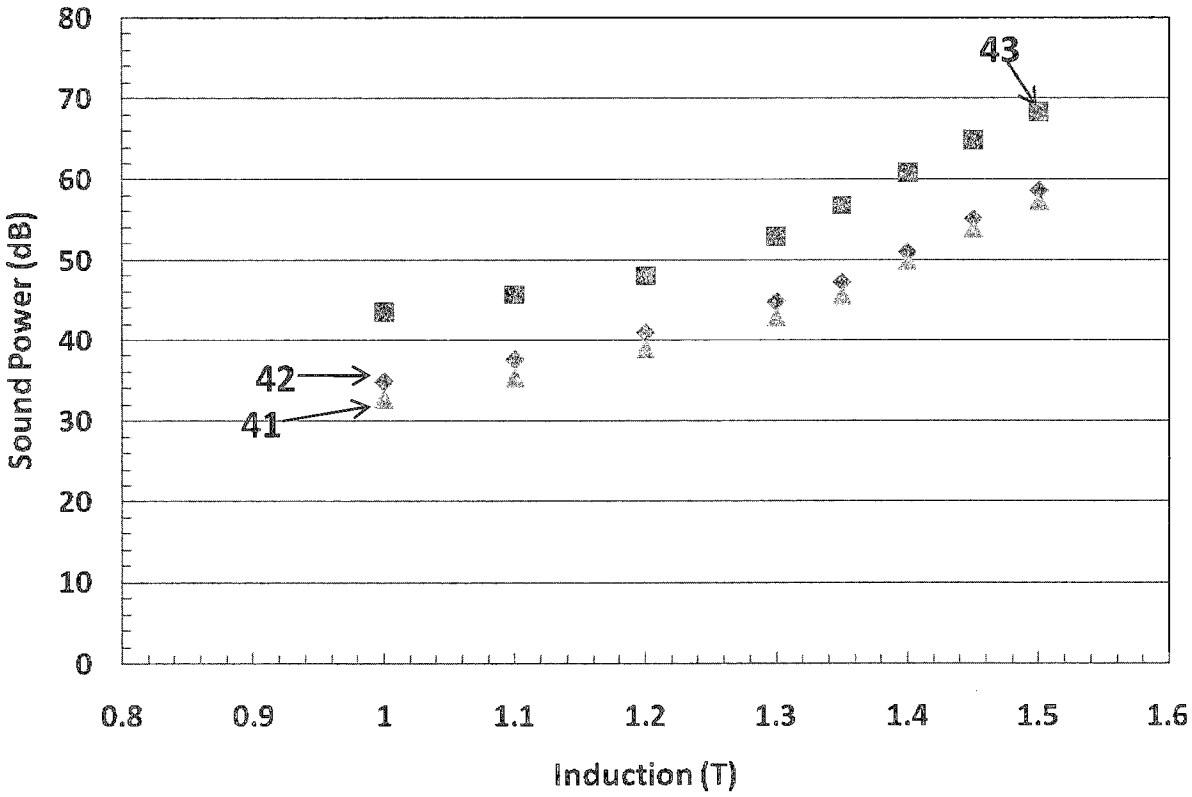
FIG. 4 is a graph showing magnetic induction dependence of sound power emanating from a magnetic core based on Metglas® 2605SA1 alloy under 60 Hz excitation wrapped by an insulating high strength tape.

The sound power data in Table I is shown in FIG. 4 for visual comparison. In FIG. 4, curves 41, 42 and 43 are for the cores designated as "Bare", "Taped-A" and "Glued", respectively. It is noted that noise levels on taped cores were only slightly higher than those from a bare core which was neither epoxy-coated nor taped. On the other hand, the glued core emanated significantly higher noise compared to the bare or taped cores by about 10 dB above 1.3 T excitation, which is the operating induction range in transformers. The sound power data taken on "Taped-B" core are not shown in FIG. 4. This is because the long-term heat resistance of polyester Tape B supplied by PPI Adhesive Products Ltd and used in the "Taped-B" core is sufficient only for temperatures below 130° C. Also Tape B has a tensile strength of 250 N/cm and a dielectric strength of 5000 volts. The upper temperature limit for continuous use of Tape B is close to the upper temperature limit for electrical insulation material and core cooling oil, and thus its use is not practical although its sound power performance is acceptable. Another similar polyester tape with a dielectric strength of 2000 volts tested favorably from magnetics standpoint but its dielectric properties are not acceptable as some of the transformer coil windings have to handle line voltages exceeding 3000 volts. On the other hand, polyester Tape A supplied by Intertape Polymer Group used in "Taped-A" core has a service temperature up to 155° C. In addition to the high thermal stability of the tape, the tape has a high tensile strength of 512 N/cm and a high dielectric strength of 4600 volts. Further requirements for the acceptable tapes include good puncture, abrasion, tear and thermal aging resistance.

Prior to the sound power tests, core loss and exciting power on the cores of Table I were measured and the results of exciting power, which is the indicator of the power required to energize the magnetic core, are given in Table II.

TABLE II

Exciting power at 60 Hz of the cores of Table I.

| Core | Exciting Power (VA/kg) Induction (T) at 60 Hz | | | | | | | |
|---|---|---|---|---|---|---|---|---|
| Type | 1.0 T | 1.1 T | 1.2 T | 1.3 T | 1.35 T | 1.4 T | 1.45 T | 1.5 T |
| Taped-A | 0.171 | 0.213 | 0.266 | 0.340 | 0.395 | 0.477 | 0.629 | 1.00 |
| Taped-B | 0.167 | 0.207 | 0.257 | 0.326 | 0.376 | 0.449 | 0.582 | 0.914 |
| Glued | 0.172 | 0.214 | 0.270 | 0.353 | 0.421 | 0.530 | 0.751 | 1.30 |
| Bare | 0.167 | 0.206 | 0.256 | 0.326 | 0.380 | 0.464 | 0.621 | 1.00 |

As noted in Table II, the exciting power in the taped and bare cores were about the same, whereas the exciting power in the glued (epoxy-coated) core showed about 10-30% higher exciting power compared to the taped and bare cores for excitation above 1.3 T. The increase in exciting power indicates that epoxy-coating and subsequent hardening introduced local mechanical stress near the core edges. This local stress in turn increased the audible noise from the glued cores compared to the core without glue as evidenced in Table I and FIG. 4. Core loss, on the other hand, was not affected significantly by core edge coating by epoxy or wrapping the core with high strength tape. For example, at exciting induction levels of 1.0, 1.2, 1.3, 1.4 and 1.5 T, core loss in all the cores tested at 60 Hz was at 0.14, 0.17, 0.20, 0.24, 0.28 and 0.33 W/kg, respectively.

In addition to the above mentioned detrimental effects caused by gluing the core edges by epoxy resin, gluing required a resin curing process which was performed at an elevated temperature of about 150° C. for about 2 hours with a cooling time of about 1.5 hours. This resin curing process was eliminated by adopting the present invention, reducing the core production time and cost considerably. Furthermore, the epoxy gluing process of core edges is difficult to be automated whereas the tape wrapping process of the cores of the present invention is easily automated.

Example 2

Magnetic cores based on commercially available amorphous alloy Metglas®2605SA1 were tested for their audible noise at a different operating frequency. The test results are summarized in Table III, where audible noise are compared among differently prepared magnetic cores excited at induction levels 1.0-1.50 T at 50 Hz.

TABLE III

Sound power emanating from taped, epoxy coated (glued) and bare cores.

| Core | Sound Power (dB) Induction (T) at 50 Hz | | | | | | | |
|---|---|---|---|---|---|---|---|---|
| Type | 1.0 T | 1.1 T | 1.2 T | 1.3 T | 1.35 T | 1.4 T | 1.45 T | 1.5 T |
| Taped-A | 31.9 | 34.3 | 37.4 | 42.0 | 44.7 | 47.9 | 51.7 | 55.8 |
| Taped-B | 32.0 | 34.2 | 37.2 | 41.2 | 43.7 | 47.2 | 51.1 | 56.0 |
| Glued | 37.9 | 40.8 | 44.5 | 49.8 | 53.0 | 56.5 | 59.8 | 62.9 |
| Bare | 30.3 | 32.4 | 35.3 | 39.6 | 42.2 | 46.8 | 51.1 | 55.2 |

Tape A: Product Code 4237 (Intertape Polymer);
Tape B: Product Code 1711 (PPI)

It is noted that noise levels on taped cores were only slightly higher than those from a bare core which was neither epoxy-coated nor taped. On the other hand, the glued core emanated significantly higher noise compared to the taped cores by about 9 dB above 1.3 T excitation, which is the operating induction range in transformers. Prior to the sound power tests, core loss and exciting power on the cores of Table III under 50 Hz excitation were measured and the results of exciting power, which is the indicator of the power required to energize the magnetic core, are given in Table IV.

TABLE IV

Exciting power at 50 Hz of the cores of Table III.

| Core | Exciting Power (VA/kg) Induction (T) at 50 Hz | | | | | | | |
|---|---|---|---|---|---|---|---|---|
| Type | 1.0 T | 1.1 T | 1.2 T | 1.3 T | 1.35 T | 1.4 T | 1.45 T | 1.5 T |
| Taped-A | 0.141 | 0.171 | 0.211 | 0.271 | 0.316 | 0.390 | 0.518 | 0.837 |
| Taped-B | 0.136 | 0.166 | 0.204 | 0.260 | 0.300 | 0.365 | 0.478 | 0.763 |
| Glued | 0.140 | 0.172 | 0.215 | 0.283 | 0.338 | 0.436 | 0.625 | 1.09 |
| Bare | 0.135 | 0.164 | 0.202 | 0.260 | 0.303 | 0.378 | 0.511 | 0.836 |

As noted in Table IV, exciting power in the taped and bare cores were about the same, whereas exciting power in the glued (epoxy-coated) core showed about 10-30% higher exciting power compared to the taped and bare cores for excitation above 1.3 T. Core loss, on the other hand, was not affected considerably by core edge coating by epoxy or wrapping the core with high strength tape. For example, at exciting induction levels of 1.0, 1.2, 1.3, 1.4 and 1.5 T, core loss in all the cores tested at 50 Hz was at 0.11, 0.17, 0.16, 0.19, 0.22 and 0.26 W/kg, respectively.

In addition to the detrimental effects caused by epoxy gluing of core edges, core production cost and time are reduced considerably.

Example 3

Magnetic cores based on commercially available amorphous alloy Metglas®2605HB1M were tested for their audible noise. The test results are summarized in Table V, where audible noise are compared among differently prepared magnetic cores excited at induction levels 1.0-1.55 T at 60 Hz.

TABLE V

Sound power emanating from taped, epoxy coated (glued) and bare cores.

| | Sound Power (dB) Induction (T) at 60 Hz | | | | | | | | |
|---|---|---|---|---|---|---|---|---|---|
| Core Type | 1.0 T | 1.1 T | 1.2 T | 1.3 T | 1.35 T | 1.4 T | 1.45 T | 1.5 T | 1.55 T |
| Taped-A | 33.6 | 35.9 | 39.3 | 43.6 | 46.2 | 49.0 | 51.9 | 54.6 | 58.8 |
| Taped-B | 33.6 | 35.7 | 38.4 | 42.3 | 44.4 | 46.7 | 50.3 | 55.3 | 60.7 |
| Glued | 41.1 | 43.1 | 45.6 | 49.4 | 52.2 | 55.5 | 59.8 | 64.0 | 67.6 |
| Bare | 31.7 | 34.0 | 37.4 | 41.5 | 44.0 | 47.0 | 50.7 | 54.3 | 57.7 |

Tape A: Product Code 4237 (I37.7ntertape Polymer)
Tape B: Product Code 1711A (PPI)

Figure 5:
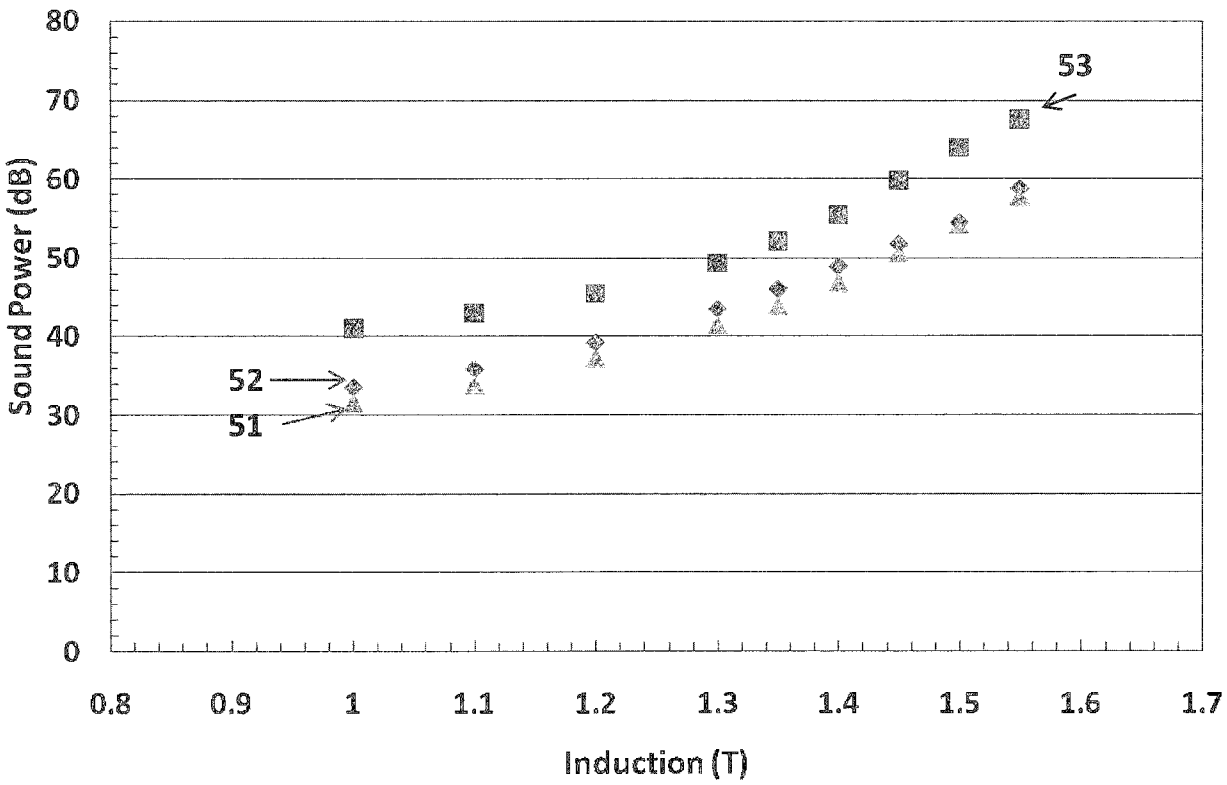
FIG. 5 is a graph showing magnetic induction dependence of sound power emanating from a magnetic core based on Metglas® 2605HB!M alloy under 60 Hz excitation wrapped by an insulating high strength tape.

The sound power data in Table V is shown in FIG. 5 for visual comparison. In FIG. 5, curves 51, 52 and 53 are for the cores designated as "Bare", "Taped-A" and "Glued", respectively. It is noted that noise levels on taped cores were higher only by 1-2 dB than those from a bare core which was neither epoxy-coated nor taped. On the other hand, the glued core emanated significantly higher noise compared to the bare or taped cores by 8-10 dB above 1.3 T excitation, which is the operating induction range in transformers. Prior to the sound power tests, core loss and exciting power on the cores of Table V were measured and the results of exciting power, which is the indicator of the power required to energize the magnetic core, are given in Table VI.

TABLE VI

Exciting power at 60 Hz of the cores of Table V.

| | Exciting Power (VA/kg) Induction (T) at 60 Hz | | | | | | | | |
|---|---|---|---|---|---|---|---|---|---|
| Core Type | 1.0 T | 1.1 T | 1.2 T | 1.3 T | 1.35 T | 1.4 T | 1.45 T | 1.5 T | 1.55 T |
| Taped-A | 0.148 | 0.186 | 0.233 | 0.296 | 0.340 | 0.403 | 0.505 | 0.692 | 1.10 |
| Taped-B | 0.144 | 0.181 | 0.226 | 0.285 | 0.325 | 0.383 | 0.477 | 0.653 | 1.04 |
| Glued | 0.148 | 0.186 | 0.236 | 0.306 | 0.359 | 0.440 | 0.578 | 0.836 | 1.38 |
| Bare | 0.144 | 0.182 | 0.229 | 0.296 | 0.346 | 0.421 | 0.549 | 0.786 | 1.22 |

As noted in Table VI, exciting power in the taped cores was slightly lower or about the same as that in the bare core, whereas exciting power in the glued (epoxy-coated) core showed about 5-30% higher exciting power compared to the taped cores for excitation above 1.3 T. The increase in exciting power indicates that epoxy-coating and subsequent hardening introduced local mechanical stress near the core edges. This local stress in turn increased the audible noise from the glued cores compared to the core without glue as evidenced in Table V and FIG. 5. The effect of the local stress on the exciting power was about the same as in the case of Metglas® 2605SA1-based cores (see Table II) reflecting the fact that both Metglas® 2605SA1 and 2706HB1M alloy have the same magnetostriction of 27 ppm. Core loss, on the other hand, was not affected by core edge coating by epoxy or wrapping the core with high strength tape. For example, at exciting induction level of 1.0, 1.2, 1.3, 1.4, 1.5 T and 1.55 T, core loss in all the cores tested at 60 Hz was at 0.12, 0.15, 0.17, 0.20, 0.24, 0.28 and 0.31 W/kg, respectively.

In addition to the detrimental effects caused by epoxy gluing of core edges, the core wrapping process of the present invention reduced the production cost and time of transformer cores.

Example 4

Magnetic cores based on commercially available amorphous alloy Metglas®2605HB1M under a different operating frequency were tested for their audible noise. The test results are summarized in Table VII, where audible noise is compared among differently prepared magnetic cores excited at induction levels 1.0-1.55 T at 50 Hz.

TABLE VII

Sound power emanating from taped, epoxy coated (glued) and bare cores.

| | Sound Power (dB) Induction (T) at 50 Hz | | | | | | | | |
|---|---|---|---|---|---|---|---|---|---|
| Core Type | 1.0 T | 1.1 T | 1.2 T | 1.3 T | 1.35 T | 1.4 T | 1.45 T | 1.5 T | 1.55 T |
| Taped-A | 31.7 | 33.7 | 36.5 | 40.7 | 43.1 | 45.5 | 48.3 | 52.0 | 56.4 |
| Taped-B | 30.4 | 31.8 | 34.0 | 37.6 | 40.0 | 43.0 | 48.1 | 52.8 | 56.7 |
| Glued | 40.6 | 42.2 | 44.3 | 46.9 | 48.3 | 51.7 | 57.4 | 61.8 | 65.7 |
| Bare | 30.1 | 31.8 | 35.0 | 38.9 | 41.5 | 44.3 | 47.7 | 51.2 | 55.2 |

Tape A: Product Code 4237 (I37.7ntertape Polymer)

Tape B: Product Code 1711A (PPI)

It is noted that noise levels on taped cores were higher only by about 1 dB than those from a bare core which is neither epoxy glue-coated nor taped. On the other hand, the glued core emanated significantly higher noise compared to the bare or taped cores by 6-10 dB above 1.3 T excitation which is the operating induction range in transformers. Prior to the sound power tests, core loss and exciting power on the cores of Table V were measured and the results of exciting power, which is the indicator of the power required to energize the magnetic core, are given in Table VIII.

TABLE VIII

Exciting power at 50 Hz of the cores of Table V.

| | Exciting Power (VA/kg) Induction (T) at 50 Hz | | | | | | | | |
|---|---|---|---|---|---|---|---|---|---|
| Core Type | 1.0 T | 1.1 T | 1.2 T | 1.3 T | 1.35 T | 1.4 T | 1.45 T | 1.5 T | 1.55 T |
| Taped-A | 0.121 | 0.148 | 0.184 | 0.235 | 0.272 | 0.326 | 0.411 | 0.572 | 0.938 |
| Taped-B | 0.117 | 0.144 | 0.178 | 0.226 | 0.260 | 0.309 | 0.388 | 0.540 | 0.887 |
| Glued | 0.120 | 0.148 | 0.187 | 0.244 | 0.288 | 0.358 | 0.475 | 0.698 | 1.19 |
| Bare | 0.118 | 0.145 | 0.181 | 0.235 | 0.276 | 0.340 | 0.448 | 0.648 | 1.07 |

As noted in Table VIII, exciting power in the taped cores was slightly lower or about the same as that in the bare core, whereas exciting power in the glued (epoxy-coated) core showed about 6-30% higher exciting power compared to the taped cores for excitation above 1.3 T. Core loss, on the other hand, was not affected by core edge coating by epoxy or wrapping the core with high strength tape. For example, at exciting induction levels of 1.0, 1.2, 1.3, 1.4, 1.5 T and 1.55 T, core loss in all the cores tested at 50 Hz was at 0.09, 0.11, 0.13, 0.16, 0.19, 0.22 and 0.25 W/kg, respectively.

In addition to the detrimental effects caused by epoxy gluing of core edges, the process of the core wrapping of the present invention reduced the core production cost and time.

In addition to the considerable noise reduction in transformer cores, tapes used in wrapping the cores can be easily removed, enabling environmental-friendly recycling of the core materials.

All examples and conditional language recited herein are intended for pedagogical objects to aid the reader in understanding the invention and the concepts contributed by the inventors to furthering the art, and are to be construed as being without limitation to such specifically recited examples and conditions, nor does the organization of such examples in the specification relate to a showing of the superiority and inferiority of the invention. Although embodiments of the present inventions have been described in detail, it should be understood that the various changes, substitutions, and alterations could be made hereto without departing from the spirit and scope of the invention.

What is claimed is:

1. An amorphous alloy-based magnetic core having reduced audible noise, comprising:

a rectangular shape core having four legs:

a first core leg, a second core leg being opposite to the first core leg and having a cut ribbon overlap section, a third core leg, and a fourth core leg being opposite to the third core leg;

a plurality of non-overlapping high strength tapes placed on the sides of the third core leg and the fourth core leg, wherein the high strength tapes exhibit high mechanical strength, high dielectric strength, and high service temperature;

a first layer of overlapping high strength tapes wrapped helically on the third core leg and the fourth core leg;

a second layer of overlapping high strength tapes placed on a top face of the first core leg in a direction parallel to the length of the first core leg;

a third layer of overlapping high strength tapes placed on the top face of the first core leg in a direction perpendicular to the length of the first core leg;

a fourth layer of overlapping high strength tapes placed on a bottom face of the first core leg in a direction parallel to the length of the first core leg; and a fifth layer of overlapping high strength tapes placed on the bottom face of the first core leg in a direction perpendicular to the length of the first core leg, wherein the magnetic core having a reduced level of audible noise emanating from the core.

2. The core according to claim 1, wherein the portion of the core that is not covered with the tape is exposed to a transformer cooling media to assure core cooling during an operation of the core in an electrical distribution transformer.

3. The core according to claim 1, wherein each of the first layer of overlapping high strength tapes, the second layer of overlapping high strength tapes, the third layer of overlapping high strength tapes, the fourth layer of overlapping high strength tapes, and the fifth layer of overlapping high strength tapes provide mechanical strength to the core.

4. The core according to claim 1, wherein the core is operable up to 155° C., and the high strength tape has a tensile strength exceeding 250 N/cm and a dielectric strength exceeding 3000 volts, the high strength tape having good puncture, tear and thermal aging resistance.

5. The core according to claim 1, wherein the magnetic core is wound with an amorphous magnetic tape or magnetic ribbon, wherein the magnetic ribbon is rapidly cast from its molten state of the alloy.

6. The core according to claim 1, wherein the magnetic core wrapped with multiple layers of high strength tapes emanates sound power close to the sound power generated by a same-sized core with no tape wrapping.

7. The core according to claim 1, wherein the reduced level of audible noise of the magnetic core is 6-10 dB less than a same-size magnetic core having resin as coating.

8. The core according to claim 1, wherein layers of high strength tapes can be removed when the core is remelted for recycling.

9. A method of reducing low audible noise of an amorphous alloy-based magnetic core, comprising:

providing the magnetic core having four core legs arranged in a rectangular shape, the magnetic core further comprising:

a first core leg, a second core leg being opposite to the first core leg and having a cut ribbon overlap section, a third core leg, and a fourth core leg being opposite to the third core leg;

placing a plurality of non-overlapping high strength tapes on the sides of the third core leg and the fourth core leg, wherein the high strength tapes exhibit high mechanical strength, high dielectric strength, and high service temperature;

wrapping a first layer of overlapping high strength tapes helically on the third core leg and the fourth core leg;

placing a second layer of overlapping high strength tapes on a top face of the first core leg in a direction parallel to the length of the first core leg;

placing a third layer of overlapping high strength tapes on the top face of the first core leg in a direction perpendicular to the length of the first core leg;

placing a fourth layer of overlapping high strength tapes on a bottom face of the first core leg in a direction parallel to the length of the first core leg; and placing a fifth layer of overlapping high strength tapes on the bottom face of the first core leg in a direction perpendicular to the length of the first core leg, the magnetic core having a reduced level of audible noise emanating from the core.

10. The method according to claim 9, further comprising: exposing a portion of the first core leg that is without tape wrapping, a portion of the third core leg that is without tape wrapping, or a portion of the fourth core leg that is without tape wrapping to a transformer cooling media to assure core cooling during an operation of the core in an electrical distribution transformer.

11. The method according to claim 9, wherein each of the first layer of overlapping high strength tapes, the second layer of overlapping high strength tapes, the third layer of overlapping high strength tapes, the fourth layer of overlapping high strength tapes, and the fifth layer of overlapping high strength tapes provide mechanical strength to the core.

12. The method according to claim 9, wherein the core is operable up to 155° C., and the high strength tape has a tensile strength exceeding 250 N/cm and a dielectric strength exceeding 3000 volts, the high strength tape having good puncture, tear and thermal aging resistance.

13. The method according to claim 9, wherein the magnetic core is wound with an amorphous magnetic tape or magnetic ribbon, wherein the magnetic ribbon is rapidly cast from its molten state of the alloy.

14. The method according to claim 9, wherein the magnetic core wrapped with multiple layers of high strength tapes emanates sound power close to the sound power generated by a same-sized core with no tape wrapping.

15. The method according to claim 9, wherein the reduced level of audible noise of the magnetic core is 6-10 dB less than a same-size magnetic core having resin as coating.

16. The method according to claim 9, wherein layers of high strength tapes can be removed when the core is remelted for recycling.

* * * * *